United States Patent [19]

Takahashi

[11] Patent Number: 4,558,332

[45] Date of Patent: Dec. 10, 1985

[54] INK JET PRINTER

[75] Inventor: Hiroshi Takahashi, Yokohama, Japan

[73] Assignee: Canon Kabushiki Kaisha, Tokyo, Japan

[21] Appl. No.: 476,480

[22] Filed: Mar. 18, 1983

[30] Foreign Application Priority Data

Apr. 2, 1982 [JP] Japan ..... 57-53750[U]
Apr. 2, 1982 [JP] Japan ..... 57-53751[U]

[51] Int. Cl.[4] ..... G01D 15/18
[52] U.S. Cl. ..... 346/140 R
[58] Field of Search ..... 346/140, 75; 358/75; 400/126

[56] References Cited

U.S. PATENT DOCUMENTS 3,683,212 8/1972 Zoltan ..... 346/140 X
3,925,788 12/1975 Kashio ..... 346/75
3,946,398 3/1976 Kyser et al. ..... 346/140 X
4,001,839 1/1977 Kraus ..... 346/75
4,144,537 3/1979 Kimura et al. ..... 346/140
4,176,363 11/1979 Kashahara ..... 346/140 R
4,313,684 2/1982 Tazaki et al. ..... 346/140 X

*Primary Examiner*—Joseph W. Hartery
*Attorney, Agent, or Firm*—Fitzpatrick, Cella, Harper & Scinto

[57] ABSTRACT

A multi-nozzle ink jet printer has a plurality of ink jet nozzles and a detection circuit for detecting when one of the plurality of ink jet nozzles has been in a non-print mode for a predetermined time period. If the ink jet nozzle which has been in the non-print mode for more than the predetermined time period is to be used for printing, a printer controller causes the ink jet nozzle to be scavenged prior to printing.

9 Claims, 10 Drawing Figures

INK JET PRINTER

BACKGROUND OF THE INVENTION

The present invention relates to an ink jet printer, and more particularly to the structure of an ink jet printer.

In a prior art ink jet printer which does not eject ink in a non-print mode, the ink is solidified around a nozzle and the ejection of the ink is prevented if a non-printing period lasts too long. Accordingly, the non-print mode time period is measured and if the non-print mode time period lasts over a predetermined time period the ink jet nozzle is scavenged in order to prevent the solidification of the ink.

Recently, a multi-color ink jet printer which has a number of nozzles for inks of different colors and which selectively drives the nozzles to print characters in desired colors has been proposed. When the scavenging means are to be provided in such an ink jet printer, as many such means as the number of nozzles are required. Thus, the larger the number of nozzles, the more complex is the circuit configuration.

SUMMARY OF THE INVENTION

It is an object of the present invention to provide an ink jet printer which prevent inks from being solidified around nozzles with a simple structure.

It is another object of the present invention to provide an ink jet printer which causes all of the nozzles to be scavenged if a non-print mode time period of at least one of the nozzles exceeds a predetermined time period.

It is another object of the present invention to provide an ink jet printer which measures non-print mode time periods of a plurality of nozzles by a single timer circuit to control the scavenging of the ink jet nozzles.

It is a further object of the present invention to provide an ink jet printer which has a circuit for detecting change of a printer color in addition to the timer circuit to measure the non-print mode time period, and if an ink jet nozzle which has not been used for printing in an immediately previous print cycle is to be used as a result of the change of the print color, causes that ink jet nozzle to be scavenged prior to printing in order to positively prevent the solidification of the ink.

DETAILED DESCRIPTION OF THE PREFERRED EMBODIMENTS

Figure 1:
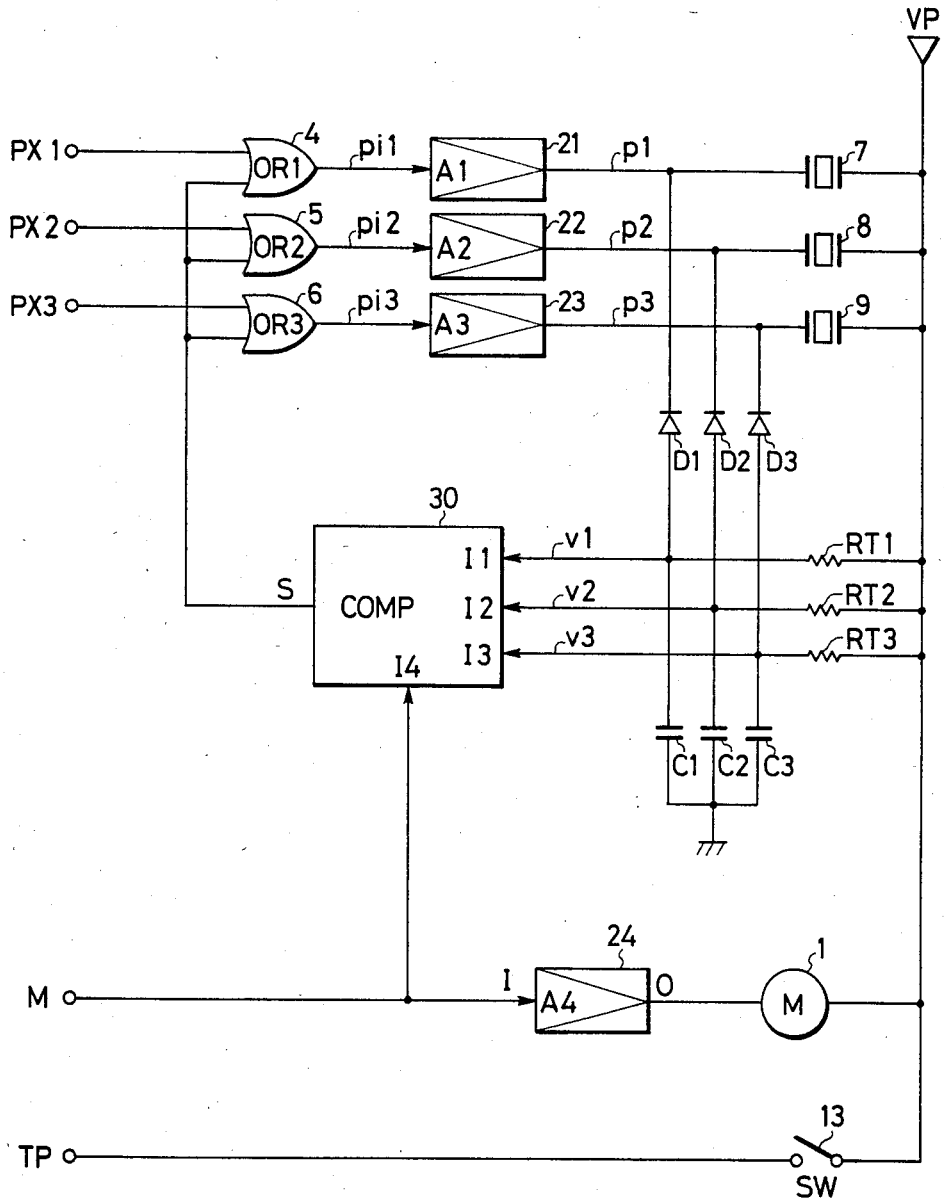
FIG. 1 shows a block diagram of an overall configuration of a control circuit of an ink jet printer of the present invention.

FIG. 1 shows one embodiment of a control circuit of an ink jet printer of the present invention, in which numeral 1 denotes a motor for driving a carriage on which ink jet nozzles are mounted. It is connected to a power supply VP and a drive output terminal of a drive amplifier 24. A motor drive signal M is supplied to an input terminal of the drive amplifier 24 and to an input terminal I4 of a voltage comparator 30.

An output S from the voltage comparator 30 is supplied to OR gates 4, 5 and 6 having piezoelectric device drive signals (record signals) PX1, PX2 and PX3 applied to second input terminals thereof, respectively. Outputs Pi1, Pi2 and Pi3 from the OR gates 4, 5 and 6, respectively, are supplied to drive amplifiers 21, 22 and 23, respectively.

Outputs P1, P2 and P3 from the drive amplifiers 21, 22 and 23 are supplied to piezoelectric devices 7, 8 and 9, respectively, having second input terminals thereof connected to the power supply VP.

The piezoelectric devices 7, 8 and 9 are used to eject inks of different colors. When they are energized, the inks are ejected from nozzles, not shown.

The output signals P1, P2 and P3 from the drive amplifiers 21, 22 and 23 are supplied to input terminals I1, I2 and I3 of the voltage comparator 30 through diodes D1, D2 and D3, respectively. Resistors RT1, RT2 and RT3 and capacitors C1, C2 and C3 are connected to the input terminals I1, I2 and I3, respectively, of the voltage comparator 30, and the other terminals of the resistors RT1, RT2 and RT3 are connected to the power supply VP and the other terminals of the capacitors C1, C2 and C3 are grounded.

The resistors RT1, RT2 and RT3 and the capacitors C1, C2 and C3 form time constant circuits, respectively. When the output signals P1, P2 and P3 of the drive amplifiers 21, 22 and 23 are at low level, the capacitors C1, C2 and C3 are discharged through the diodes D1, D2 and D3 and input voltages v1, v2 and v3 to the input terminals I1, I2 and I3 of the voltage comparator 30 assume a low level. When the output signals P1, P2 and P3 are at high level, the capacitors C1, C2 and C3 are charged by the power supply VP through the resistors RT1, RT2 and RT3 for a predetermined time period so that the input voltages v1, v2 and v3 are gradually changed to high level.

A timing switch 13 is connected to the power supply VP and it is turned on and off in synchronism with the carriage movement by a relay solenoid, not shown, to produce a timing pulse TP. This pulse is used by another control circuit to drive the piezoelectric devices 7, 8 and 9 by the signals PX1, PX2 and PX3 to print characters.

Figure 2:
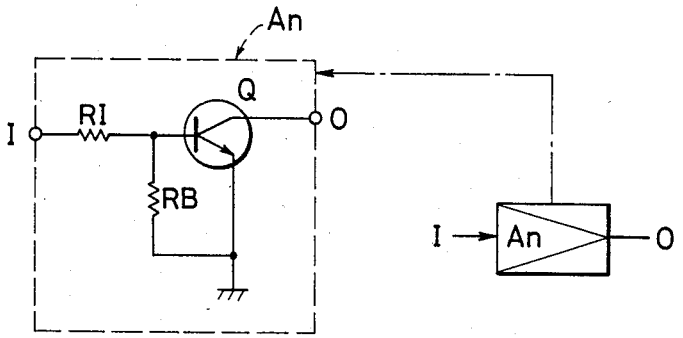
FIGS. 2 and 3 show circuit diagrams of portions of the circuit of FIG. 1.

FIG. 2 shows an embodiment of the drive amplifiers 21, 22, 23 and 24 shown in FIG. 1. It comprises a transistor Q, a base input resistor RI and a bias resistor RB. When a high level signal is applied to an input terminal I, a base current flows through the resistor RI so that the transistor Q conducts to render an output O to low level. If the input terminal I is at low level, the base current does not flow in the transistor Q and the output O is at high level.

Figure 3:
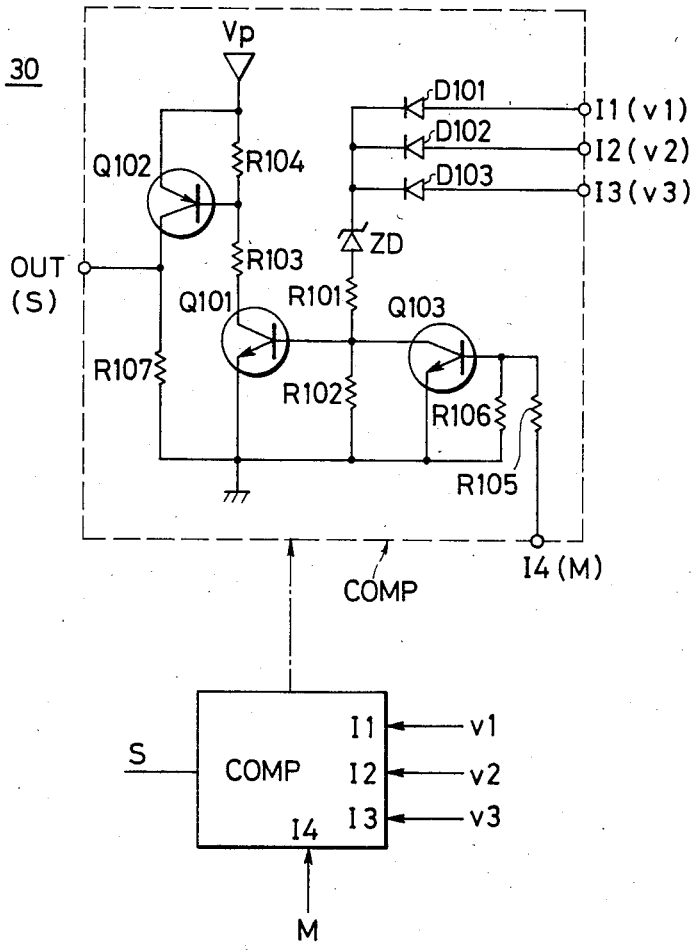

FIG. 3 shows an embodiment of the voltage comparator 30 shown in FIG. 1. Diodes D101, D102 and D103 are connected to the input terminals I1, I2 and I3, respectively, and cathodes of the diodes D101, D102 and D103 are connected to the base of a transistor Q101 and the collector of a transistor Q103 through a Zener diode ZD and a resistor R101. A resistor R102 is connected between the junction of the base of the transistor Q101 and the collector of the transistor Q103, and ground.

An emitter of the transistor Q101 is grounded and the collector thereof is connected to the base of a transistor Q102 through a resistor R103.

The power supply VP is supplied to the base of the transistor Q102 through a resistor R104 and directly to a collector thereof. The output terminal S is connected to the emitter of the transistor Q102 and grounded through a resistor R107.

The emitter of the transistor Q103 is directly grounded and the base thereof is grounded through a resistor R106 and connected to the input terminal to the motor drive signal M through a resistor R105.

The transistor Q103 is of npn type. When the input I4 is at high level, that is, when the motor drive signal M is at high level, a base current flows through the base resistor R105 to turn on the transistor Q103 so that the base potential of the npn transistor Q101 is rendered low and the transistor Q101 is turned off.

Thus, when the motor drive signal M is high, that is, during a print operation, the transistor Q101 is prevented from turning on under any condition so that the nozzle is scavenged only in a non-print mode.

The voltages v1, v2 and v3 are applied to the input terminals I1, I2 and I3, respectively. When one of the voltages v1, v2 and v3 reaches a predetermined reference voltage vS, a current flows through the corresponding one of the diodes D101, D102 and D103, the Zener diode ZD, the resistor R101 and the base of the npn transistor Q101 to the ground so that the transistor Q101 is turned on.

The reference voltage vS which causes the transistor Q101 to be turned on is defined by $$vS = VDf + VBE + ZE + VBE \cdot (R101 + R102)/R102 \quad (1)$$

When VDf is the forward voltage of the diodes D101, D102 and D103, ZE is the Zener voltage of the Zener diode ZD and VBE is the base-emitter voltage of the transistor Q101.

When the transistor Q101 is turned on, a base current flows in the transistor Q102 through the resistor R103 so that the transistor Q102 is turned on and a high level voltage biased by the load resistor R107 appears at the output terminal S of the voltage comparator 30.

To summarize the operation of the voltage comparator 30 of FIG. 3, when the motor drive signal M is low, that is, in the non-print mode, the voltage comparator 30 produces the high level output at the terminal S when any one of the input voltages v1, v2 and v3 to the input terminals I1, I2 and I3 exceeds the reference voltage vS.

The operation of the above circuits is now explained in detail with reference to a timing chart shown in FIG. 4, in which reference numerals of the waveforms designate the input and output signals at the terminals shown in FIGS. 1 to 3.

A control circuit, not shown, renders the motor drive signal M to high level to flow a current through a motor to drive the motor and hence to drive the carriage. Based on the resulting timing signal TP, the control circuit, not shown, renders the signals PX1, PX2 and PX3 to high level to print characters.

Since the drive amplifiers 21, 22 and 23 are constructed as described above, the output signal P1, P2 or P3 is rendered low level in accordance with the input signals Pi1, Pi2 and Pi3 supplied through the OR gates 4, 5 and 6. As a result, the corresponding one of the capacitors C1, C2 and C3 is discharged through the diode D1, D2 and D3 and the input voltage v1, v2 or v3 to the input terminal I1, I2 or I3 of the voltage comparator 30 is rendered low level in accordance with the discharge of the corresponding capacitor.

When the signal P1, P2 or P3 corresponding to the signal PX1, PX2 or PX3 is at low level, a current path from the power supply VP through the piezoelectric device 7, 8 or 9 to the transistor Q in FIG. 2 is established through the transistor Q of the drive amplifier 21, 22 or 23. As a result, the piezoelectric device 7, 8 or 9 is driven in accordance with the signal PX1, PX2 or PX3 and the ink is ejected from the nozzle associated with the piezoelectric device 7, 8 or 9 to print the desired characters.

When the piezoelectric device drive signal PX1, PX2 or PX3 is extinguished, the signal P1, P2 or P3 is returned to high level and the capacitor C1, C2 or C3 is blocked by the diode D1, D2 or D3 and it is gradually charged up by the power supply VP through the resistor RT1, RT2 or RT3 over a predetermined time period. Thus, the voltage v1, v2 or v3 represented by $$vn = VP \cdot \left(1 - e^{\frac{-t}{cn \cdot RTn}}\right) \quad (2)$$

where n=1, 2, 3 is developed at the input terminal I1, I2 or I3 of the voltage comparator 30.

Figure 4:
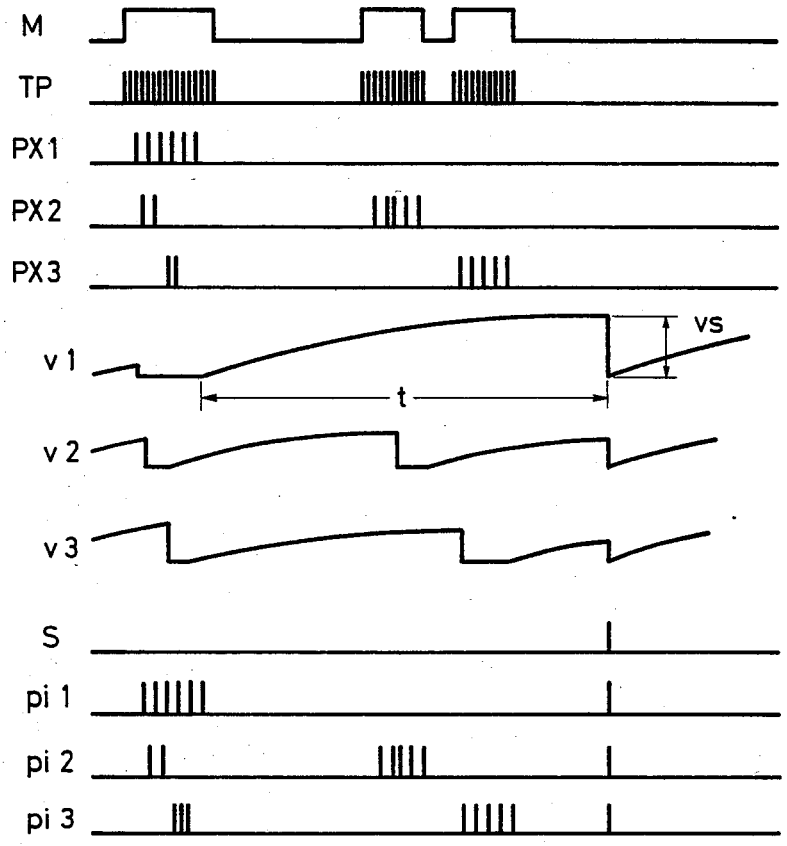
FIG. 4 shows a timing chart for illustrating a control sequence for the control circuit of the present invention.

As the print operation proceeds, if the piezoelectric device 7 is not driven by the drive signal PX1 after the first print cycle as shown in the timing chart of FIG. 4, the capacitor C1 is continuously charged and the voltage v1 at the input terminal I1 of the voltage comparator 30 rises and it finally reaches the reference voltage vS after time period t, there t is defined by $$t = -Cn \cdot RTn \cdot \log\left(1 + \frac{vS}{VP}\right) \quad (3)$$

In the present embodiment, t is set to three minutes.

When the motor 1 is not driven, that is, in the non-print mode and if at least one of the voltages v1, v2 and v3 reaches the reference voltage vS, the output S of the voltage comparator 30 assumes the high level and the high level signal is supplied to all of the drive amplifiers 21, 22 and 23 through the OR gates 4, 5 and 6 so that all of the piezoelectric devices 7, 8 and 9 are driven to scavenge or purge the nozzles by ejecting ink therefrom.

As the piezoelectric devices 7, 8 and 9 are driven, the capacitors C1, C2 and C3 are discharged in the same procedure as described above and the input voltages v1, v2 and v3 to the input terminal I1, I2 and I3 of the voltage comparator 30 are reset to the initial conditions.

While three piezoelectric devices and three ink jet nozzles are shown in the present embodiment, any number of those elements may be used.

While the ink jet nozzles are driven by the piezoelectric devices in the present embodiment, they may be driven by other drive systems.

According to the present invention, there is provided a multi-nozzle ink jet printer in which if any one of the plurality of ink jet nozzles is not driven for more than the predetermined time period, the detection circuit detects it and causes all of the ink jet nozzles to be simultaneously scavenged so that the solidification of the ink is prevented with a simple and inexpensive structure.

Another embodiment of the present invention is now explained.

Figure 5:
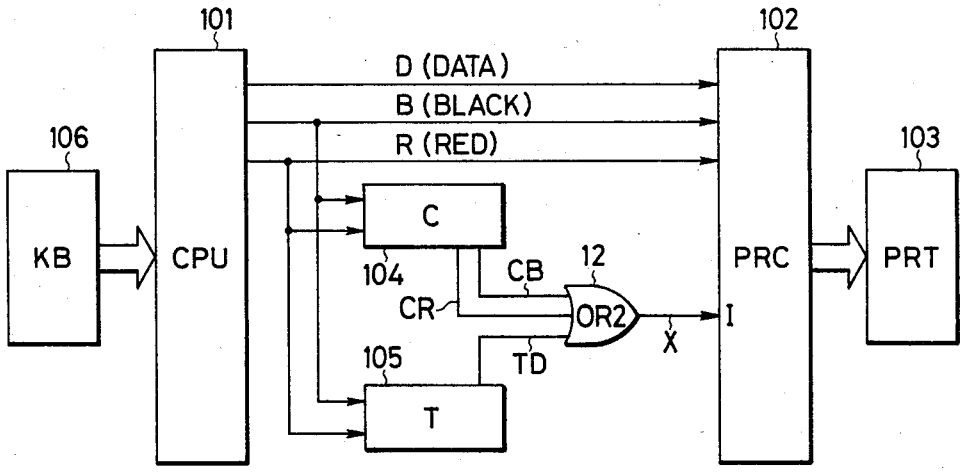
FIG. 5 shows a block diagram of an overall configuration of a control circuit of the ink jet printer of the present invention.

FIG. 5 shows a block diagram of other embodiment of the control circuit of the ink jet printer of present invention, in which numeral 101 denotes a CPU (central processing unit) which is connected to a printer controller 102 through a data signal line D, a black designation signal line B and a red designation signal line R.

Figure 6A:
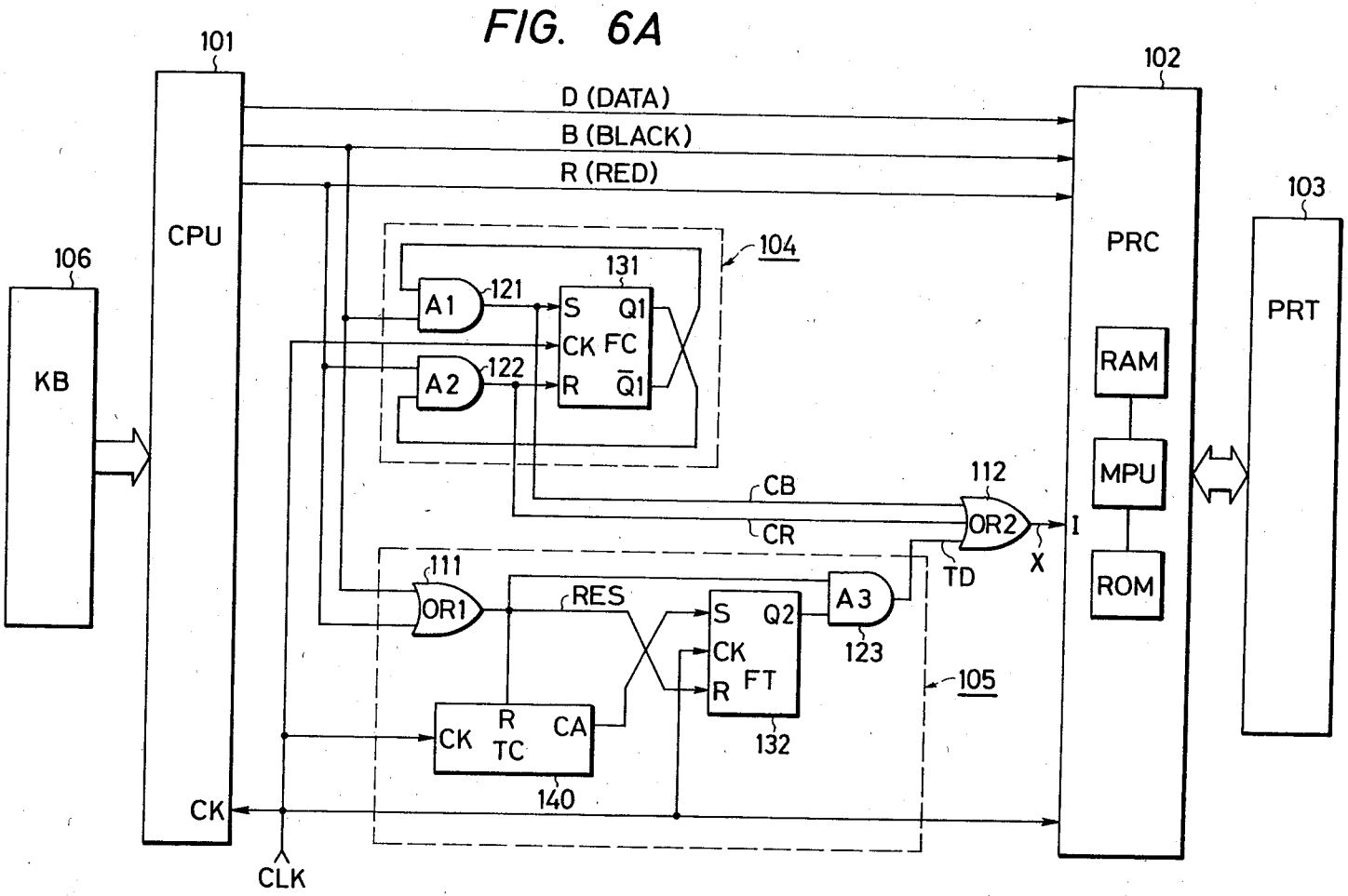
FIG. 6A shows a detailed block diagram of the circuit of FIG. 5, FIGS. 6B and 6C show timing charts for explaining the operations of portions of the control circuit of FIG. 5.
Figure 6B:
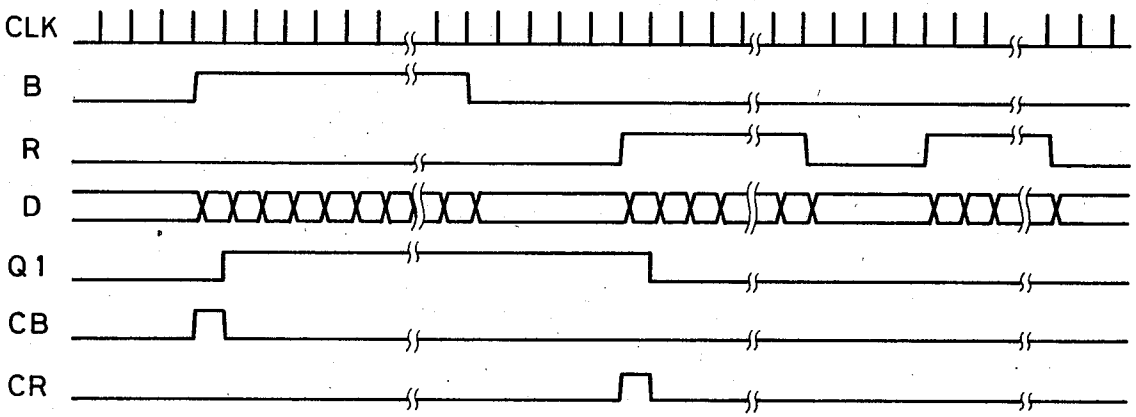
FIG. 6D shows a flow chart for explaining the operation of a portion of the control circuit of FIG. 5.
Figure 6C:
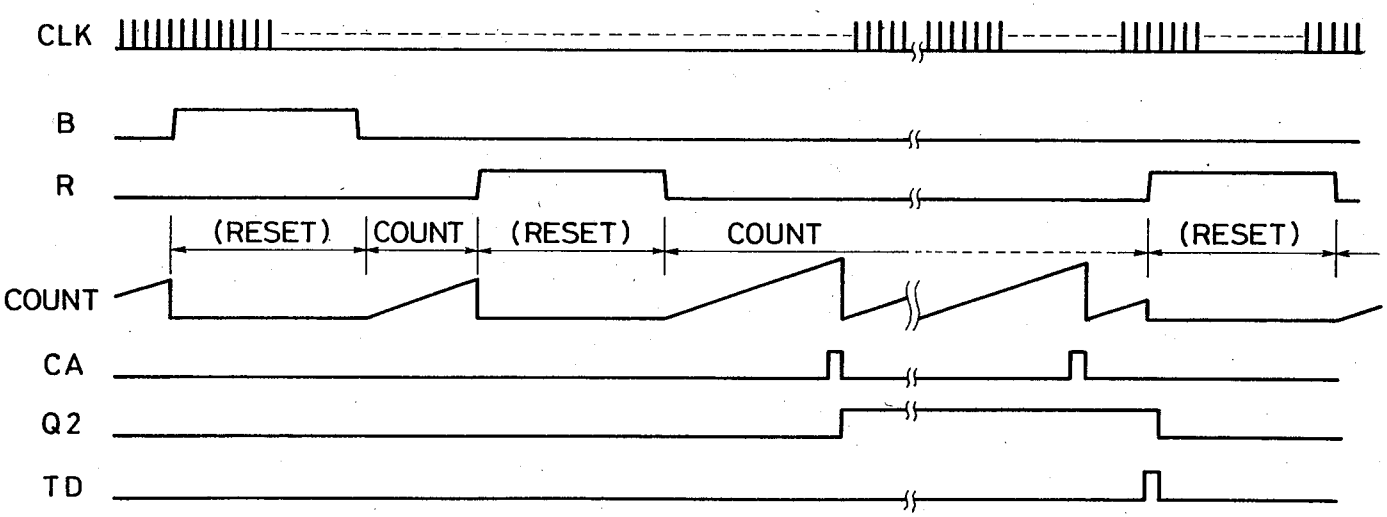
Figure 6D:
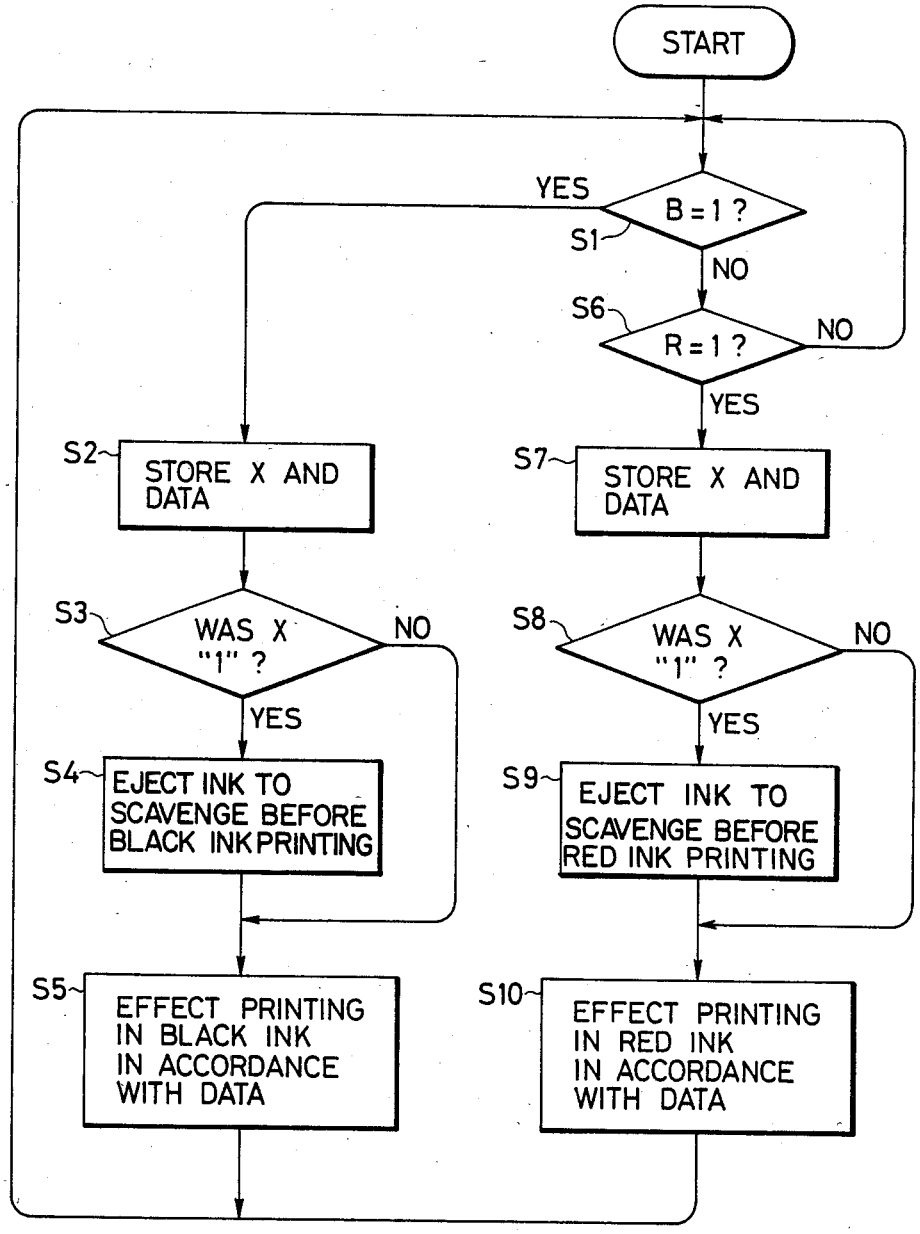

As shown in FIG. 6A, the printer controller 102 comprises a memory RAM for storing data and an output signal from an OR gate 112, a memory ROM for storing a control sequence as shown in FIG. 6D and a processor MPU which processes in accordance with the content of the memory ROM.

The data signal line D transmits the data to the printer controller 102 to control a printer 103 which causes nozzles to eject inks by piezoelectric devices to print characters.

The black designation signal B causes the printer 103 to print characters in black through the printer controller 102. It is also supplied to a print color detection circuit 104 and a timer circuit 105.

The red designation signal R causes the printer 103 to print characters in red, and it is also supplied to the print color detection circuit 104 and the timer circuit 105.

Output signals CB and CR from the print color detection circuit 104 and an output signal TD from the timer circuit 105 are supplied to an input terminal I of the printer controller 102 through an OR gate 112.

A keyboard 106 is connected to the CPU 101 through a data bus so that an operator can control the printing through the keyboard 106.

FIG. 6A shows a detail of the print color detection circuit 104 and the timer circuit 105 shown in FIG. 5.

The print color detection circuit 104 is first explained. The print color detection circuit 104 has AND gates 121 and 122 having the black designation signal B and the red designation signal R from the CPU 101 applied to first input terminals thereof, respectively. Output signals from the AND gates 121 and 122 are supplied to the OR gate 112 as the output signals CB and CR of the print color detection circuit 104. The output signal of the AND gate 121 and the output signal of the AND gate 122 are also supplied to input terminals S and R, respectively, of a flip-flop 131 which serves as a memory to store the print color, as a set signal and a reset signal thereto, respectively.

A non-inverting output Q1 of the flip-flop 131 is connected to a second input terminal of the AND gate 121 and an inverting output $\overline{Q1}$ is connected to a second input terminal of the AND gate 122.

A clock pulse CLK for controlling the operation of the entire circuit of the present invention is supplied to an input terminal CK of the flip-flop 131. The clock pulse CLK is also supplied to the CPU 101 and the printer controller 102.

The operation sequence of the print color detection circuit 104 is shown in a timing chart of FIG. 6B. As shown in FIG. 6B, the clock pulse CLK is generated at a constant period throughout the operation.

Let us assume that the data signal D and the black designation signal B are sent to print the characters in black.

The black designation circuit B is supplied to the AND gate 121. If the flip-flop 131 is now in a reset state (which indicate that the immediately previous color designation signal is R, as will be explained later), the inverting output $\overline{Q1}$ in "1". As a result, the AND gate 121 is opened to gate out the output of the print color datection signal 104 as the signal CB. Then, the flip-flop 131 is set in synchronism with the clock pulse CLK and the output signal CB is extinguished.

When the red designation signal R is next applied to the AND gate 22, the non-inverting output Q1 is "1" because the flip-flop 131 has been set by the immediately previous black designation signal B, and the AND gate 122 is opened to gate out the "1" output of the print color detection circuit 104 as the signal CR. Then, the flip-flop 131 is reset in synchronism with the clock pulse CLK and the output signal CR extinguishes.

If the red designation signal is again applied next, the flip-flop 131 is in the reset state and the non-inverting output Q1 is "0" and hence the signal CR is not produced.

In summary, the print color detection circuit 104 detects the change of the print color from red to black or black to red, and produces the "1" signal CB for the former case and the "1" signal CR for the latter case.

Returning to FIG. 6A, the timer circuit 105 is explained.

The timer circuit 105 has an OR gate 111 which receives the block designation signal B and the red designation signal R from the CPU 101. The output of the OR gate 111 is supplied to an input terminal R of a flip-flop 132 as a reset signal thereto which serves as a memory to store a signal which indicates the elapse of a predetermined time period, and also supplied to one input terminal of an AND gate 123. The output of the OR gate 111 is further connected to a reset terminal R of a counter 140.

The clock pulse CLK is supplied to the counter 140 and an output terminal CA thereof is connected to a set input terminal S of the flip-flop 132.

The clock pulse CLK is supplied to the flip-flop 132 and a non-inverting output Q2 thereof is supplied to the other input terminal of the AND gate 123, an output of which is supplied to an OR gate 112 as an output signal TD of the timer circuit 105.

FIG. 6C shows a timing chart for the operation sequence of the timer circuit 105. COUNT in FIG. 6C represents the accumulated number of the clock pulses CLK counted by the counter 140.

Let us assume that the CPU 101 now sends the black designation signal B or the red designation signal R.

The black designation signal B is supplied to the OR gate 111 to open it so that the flip-flop 132 and the counter 140 are reset. Similarly, when the red designation signal R is received, the flip-flop 132 and the counter 140 are reset.

When the black designation signal B or the red designation signal R is extinguished, the counter 140 starts to count the input clock pulse CLK. If the print color designation signal B or R is supplied during the counting, the counter 140 is again reset and counts from the beginning.

When a number of clock pulses CLK corresponding to three minutes, for example, have been counted, the counter 140 produces a pulse at the output terminal CA.

As a result, the flip-flop 132 is set in synchronism with the clock pulse CLK so that the non-inverting output Q2 assumes "1".

If the print color designation signal B or R is supplied while the flip-flop 132 is in the set state, the OR gate 111 is opened and the AND gate 123 is opened so that the signal TD from the timer circuit 105 is supplied to the OR gate 112.

After the signal TD has been outputted from one clock pulse period, the flip-flop 132 is reset in synchronism with the next clock pulse CLK and the output signal TD is extinguished.

Even if the counter 140 produces the "1" output after the flip-flop 132 has been set, the output of the timer circuit 105 does not change as shown in FIG. 6C.

In summary, when the non-print mode lasts for more than the predetermined time period (e.g. three minutes), the timer circuit 105 produces the "1" output for one clock pulse period in synchronism with the next print color designation signal B or R.

The operation of the printer controller 102 is now explained with reference to a flow chart shown in FIG. 6D, in which X denotes an output signal of an OR gate 112 connected to the input terminal I of the printer controller 102.

In a step S1, the printer controller 102 determines if the print color designation signal supplied from the processor MPU is the black designation signal B or the red designation signal R. If it is the black designation signal B, the process goes to a step S2, and if it is the red designation signal R, the process goes to a step S7.

In the step S2, The output X from the OR gate 112 and the data signal D supplied from the CPU are stored in the memory RAM of the printer controller 102.

In a step S3, the output X of the OR gate 112 is checked by the processor MPU. If the output X is "1", the process goes to a step S4 where the black ink jet nozzle of the printer 103 is scavenged for the black ink, and in a step S5, the black ink jet nozzle of the printer 103 is caused to print characters in accordance with the data stored in the memory RAM and then the process goes back to the step S1.

In the step S3, if the output X of the OR gate 112 is "0", the process goes to the step 5 to print the characters in black by the printer 103 and then the process returns to the step S1.

The steps S7 to S10 correspond to the steps S2 to S5 and the same operations as those in the steps S2 to S5 are carried out, except that the printing and the scavenging are effected by the red ink jet nozzle of the printer 103.

The construction and the operation of the respective units have thus been described. The operation of the overall configuration is now explained with reference to the block diagram of FIG. 6 and a timing chart of FIG. 7.

Figure 7:
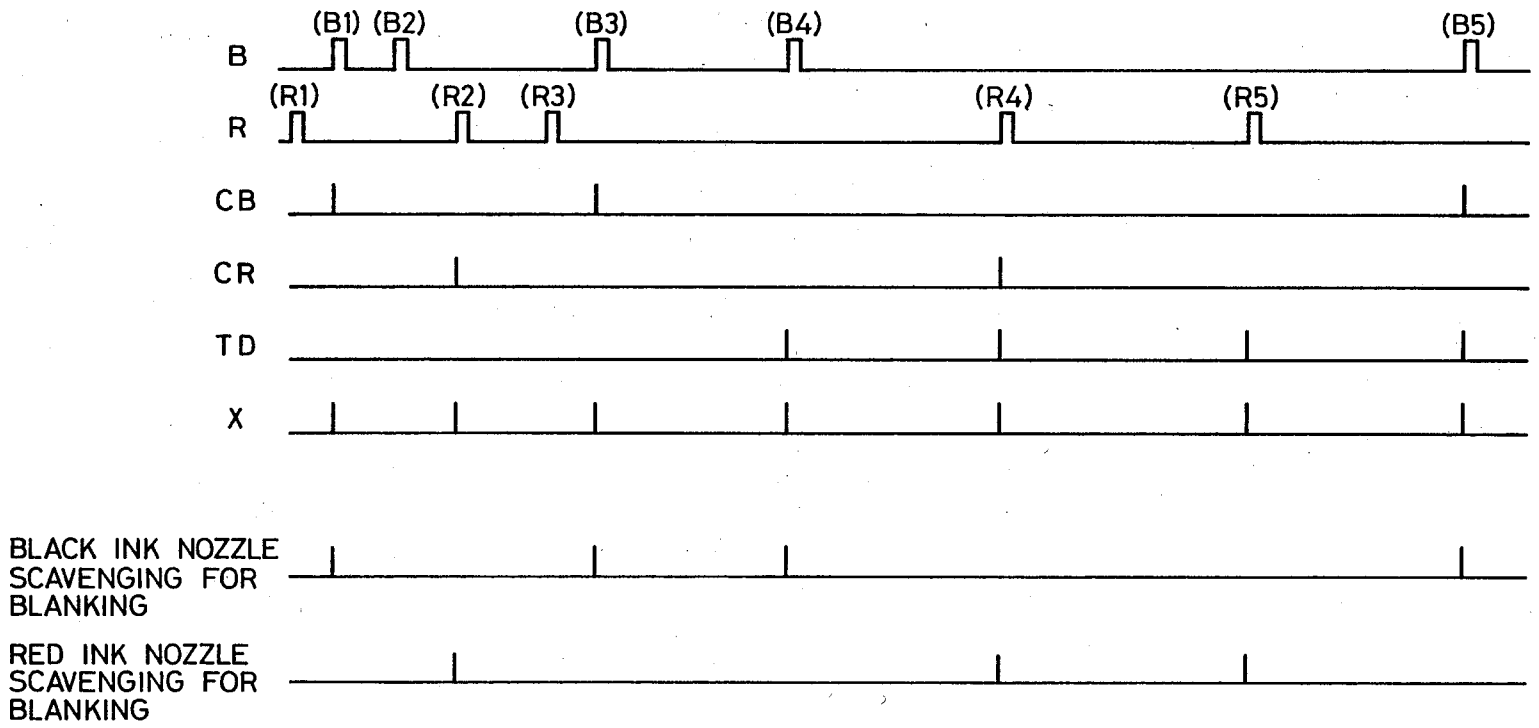
FIG. 7 shows a timing chart for explaining the operation of the control circuit of FIG. 5.

In FIG. 7, it is assumed that a first black designation signal B1 is supplied to the printer controller 102 together with the data signal D from the CPU 101. If the immediately previous print color designation signal is the red designation signal R1, the print color detection circuit 104 produces the signal CB in synchronism with the black designation signal B1 and the OR gate 112 is opened so that the output X thereof is supplied to the input terminal I of the printer controller 102.

As a result, the printer controller 102 causes the black ink jet nozzle of the printer 103 to be scavenged and then to print characters.

If the black designation signal B2 is next supplied to the printer controller 102 from the CPU 101, the outputs CB and CR of the print color detection circuit 104 are "0" because the immediately previous color designation signal was the black designation signal B1 and the non-print mode periods for black and red are within the predetermined time period (three minutes in the present embodiment) and hence the output signal TD of the timer circuit 105 is "0" and the output signal X of the OR gate 112 is "0". As a result, the printer controller 102 causes the black ink jet nozzle of the printer 103 to print characters without scavenging.

If the red designation signal R2 is next supplied from the CPU 101, the change of the print color is detected by the print color detection circuit 104 and the printer controller 102 responds to the output signal CR of the print color detection circuit 104 to cause the red ink jet nozzle of the printer 103 to print characters following scavenging.

If the red designation signal R3 is next supplied from the CPU 101, the timer circuit 105 does not produce the output because the non-print mode periods for red and black are within the predetermined time period and the printer controller 102 causes the red ink jet nozzle of the printer 103 to print characters without scavenging.

If the black designation signal B3 is next supplied to the printer controller 102 from the CPU 101, the printer controller 102 responds to the output signal CB of the print color detection circuit 104 to cause the black ink jet nozzle of the printer 103 to print characters following scavenging.

If the black designation signal B4 is supplied from the CPU 101 more than three minutes (predetermined time period) later than the input of the black designation signal B3, the print color detection circuit 104 does not produce the output but the timer circuit 105 produces the output so that the printer controller 102 causes the black ink jet nozzle of the printer 103 to print characters following scavenging.

If the red designation signal R4 is next supplied from the CPU 101 to the printer controller 102 more than three minutes later than the input of the black designation signal B4, the print color detection circuit 104 and the timer circuit 105 produce the outputs so that the printer controller 102 causes the red ink jet nozzle of the printer 103 to print characters following scavenging.

If the red designation signal R5 is next supplied from the CPU 101 to the printer controller 102 more than three minutes later than the input of the red designation signal R4, the print color detection circuit 104 does not produce the output but the timer circuit 105 produces the output so that the printer controller 102 causes the red ink jet nozzle of the printer 103 to print characters following scavenging.

If the black designation signal B5 is next supplied from the CPU 101 to the printer controller 102 more than three minutes later than the input of the red designation signal R5, the print color detection circuit 104 and the timer circuit 105 produce the outputs so that the printer controller 102 causes the black ink jet nozzle of the printer 103 to print characters following scavenging.

To summarize the overall operation, when the non-print mode lasts for more than the predetermined time period, the ink jet nozzle to be used then prints characters following non-print ink ejection, and when the print color or the ink jet nozzle is changed, the ink jet nozzle to be used then prints characters following scavenging.

While the print colors are limited to two colors, red and black, in the above embodiment, they may be other colors, and in an ink jet printer which uses three or more colors, the present invention is equally applicable with a slight modification of the print color detection circuit. The ink jet nozzles may be driven by the piezoelectric devices or thermal devices or any other means.

According to the features of the present invention, the following advantage are attained.

Since the non-print time period is measured by the single timer circuit to effect the non-print ink ejection prior to the printing if the non-print mode lasts for more than the predetermined time period, a multi nozzle ink jet printer a simple and inexpensive mechanism to prevent the drying of the ink in the vicinity of the ink jet nozzles is provided.

Further, since the ink jet printer of the present invention has the print color detection circuit to detect the change of the print color or the ink jet nozzle to be used for printing, so that the ink jet nozzle is scavenged prior to the printing when the ink jet nozzle to be used for printing is changed, drying of ink is positively prevented under any condition of usage.

I claim:

1. An ink jet printer comprising:

a plurality of nozzle means for ejecting ink droplets when said nozzle means are driven;

drive means for providing a plurality of output signals, each output signal being provided for independently driving a respective one of said plurality of nozzle means;

detection means for providing a detection signal when said drive means has failed to provide any one output signal for a predetermined time period; and scavenge means for providing a scavenge signal to drive all of said nozzle means in response to the detection signal.

2. An ink jet printer according to claim 1, wherein said nozzle means eject ink droplets by application of a voltage.

3. An ink jet printer according to claim 1, wherein said nozzle means include piezoelectric means for ejecting ink when driven by an output signal.

4. An ink jet printer according to claim 1, wherein said nozzle means include heating means for ejecting ink when driven by an output signal.

5. An ink jet printer according to claim 1, wherein said detection means includes a time constant circuit corresponding to each output signal, each said time constant constant circuit including a capacitor charged in the absence of the corresponding output signal.

6. An ink jet printer according to claim 5, wherein each time constant circuit includes a diode connected to said capacitor and the detection signal is provided at the junctions of said diodes with said capacitors.

7. An ink jet printer according to claim 1, further comprising carriage means for carrying said nozzle means.

8. An ink jet printer according to claim 1, wherein said detection means periodically provides the detection signal at time intervals corresponding to the predetermined time period when said drive means has failed to provide any one output signal during a longer time period.

9. An ink jet printer according to claim 1, wherein said nozzle means includes a plurality of a nozzles capable of ejecting ink droplets of different colors.

* * * * *

UNITED STATES PATENT AND TRADEMARK OFFICE

CERTIFICATE OF CORRECTION

PATENT NO. : 4,558,332

DATED : December 10, 1985

INVENTOR(S) : HIROSHI TAKAHASHI

It is certified that error appears in the above-identified patent and that said Letters Patent is hereby corrected as shown below:

Column 1, line 65, begin new paragraph at "FIG. 6D".

Column 4, line 33, change "input terminal" to --input terminals--;

line 41, change "there t" to --where t--; and line 60, change "input terminal" to --input terminals--.

Column 5, line 11, change "of other" to --of another--.

Column 6, line 6, change "(which indicate" to --(which indicates--;

line 8, change "$\bar{Q}1$ in "1"." to --$\bar{Q}1$ is "1".--;

line 32, change "the block designation signal B" to --the black designation signal B--; and line 37, change "and also" to --and is also--.

UNITED STATES PATENT AND TRADEMARK OFFICE

CERTIFICATE OF CORRECTION

PATENT NO. : 4,558,332

DATED : December 10, 1985

INVENTOR(S) : HIROSHI TAKAHASHI

It is certified that error appears in the above-identified patent and that said Letters Patent is hereby corrected as shown below:

Column 7, line 32, change "The output" to --the output--.

Column 9, line 11, change "following advantage" to --following advantages--; and line 16, change "printer a simple" to --printer having a simple--.

Column 10, line 18, change "time constant constant" to --time constant--.

Signed and Sealed this

*Sixteenth* Day of *September 1986*

[SEAL]

*Attest:*

DONALD J. QUIGG

*Attesting Officer*

*Commissioner of Patents and Trademarks*